US011643792B2

(12) United States Patent
Ito et al.

(10) Patent No.: US 11,643,792 B2
(45) Date of Patent: May 9, 2023

(54) WHEEL LOADER CONFIGURED TO DETERMINE A REDUCTION VALUE OF A TRAVELING DRIVE FORCE

(71) Applicant: HITACHI CONSTRUCTION MACHINERY CO., LTD., Tokyo (JP)

(72) Inventors: Kazuyuki Ito, Kobe (JP); Keisuke Naitou, Kobe (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 557 days.

(21) Appl. No.: 16/640,365

(22) PCT Filed: Mar. 6, 2019

(86) PCT No.: PCT/JP2019/008943
§ 371 (c)(1),
(2) Date: Feb. 20, 2020

(87) PCT Pub. No.: WO2019/188075
PCT Pub. Date: Oct. 3, 2019

(65) Prior Publication Data

US 2020/0173144 A1 Jun. 4, 2020

(30) Foreign Application Priority Data

Mar. 28, 2018 (JP) ..... JP2018-063204

(51) Int. Cl.
*E02F 9/20* (2006.01)
*E02F 3/28* (2006.01)
*E02F 3/43* (2006.01)

(52) U.S. Cl.
CPC ..... *E02F 9/2066* (2013.01); *E02F 3/283* (2013.01); *E02F 3/431* (2013.01)

(58) Field of Classification Search
CPC ..... E02F 9/2066; E02F 3/283; E02F 3/431; E02F 9/2062; E02F 9/2246
See application file for complete search history.

(56) References Cited

U.S. PATENT DOCUMENTS 9,555,706 B1 1/2017 Mitchell et al.
2013/0259620 A1* 10/2013 Shirao ..... E02F 9/2296 701/50

(Continued)

FOREIGN PATENT DOCUMENTS

CN 102414374 A 4/2012
EP 2 667 059 A1 11/2013

(Continued)

OTHER PUBLICATIONS

International Search Report of PCT/JP2019/008943 dated May 28, 2019.

*Primary Examiner* — James M McPherson
*Assistant Examiner* — Kyle J Kingsland
(74) *Attorney, Agent, or Firm* — Mattingly & Malur, PC

(57) ABSTRACT

Provided is a wheel loader capable of exhibiting sufficient excavation performance while suppressing slip during excavation. A control device provided on a wheel loader according to the present invention is configured to determine a reduction value (Δf') of traveling drive force based on first vehicle body acceleration (av1) of a vehicle body calculated from acceleration detected by an acceleration sensor, second vehicle body acceleration (av2) of the vehicle body calculated from rotational speed of wheels detected by a rotational speed sensor, and thrust (ph) of a hydraulic cylinder detected by a thrust sensor, and reduce the traveling drive force based on the reduction value and output the reduced traveling drive force.

4 Claims, 7 Drawing Sheets

(56) References Cited

U.S. PATENT DOCUMENTS

| | | | | |
|---|---|---|---|---|
| 2016/0024755 | A1* | 1/2016 | Kobiki | F16H 61/04 180/53.4 |
| 2016/0201294 | A1* | 7/2016 | Aoki | F02D 41/107 701/99 |

FOREIGN PATENT DOCUMENTS

| | | | |
|---|---|---|---|
| JP | 56-064041 | A | 6/1981 |
| JP | 06-058345 | A | 3/1994 |
| JP | 2001-082199 | A | 3/2001 |
| JP | 2005-146886 | A | 6/2005 |
| JP | 2009-109010 | A | 5/2009 |

* cited by examiner

W : OBJECT HANDLING LOAD
Wf : LOAD APPLIED TO FRONT WHEELS 4
L : OBJECT HANDLING LOAD POINT LENGTH
WB : WHEEL BASE LENGTH

W : OBJECT HANDLING LOAD
ph : BOOM CYLINDER THRUST (HYDRAULIC LOAD)
ah : AREA OF BOOM CYLINDER
l1, l2, Ma1, Ma2, Ma3, Ma4, Ma5: MECHANICAL PARAMETERS DETERMINED BY LOAD HANDLING POSTURE

WHEEL LOADER CONFIGURED TO DETERMINE A REDUCTION VALUE OF A TRAVELING DRIVE FORCE

TECHNICAL FIELD

The present invention relates to a wheel loader.

BACKGROUND ART

As the background art of the technical field to which the present invention belongs, for example, Patent Literature 1 describes a "driving force control device for controlling driving slip of wheels of a four-wheel drive vehicle, comprising: a longitudinal acceleration detecting means for estimating or detecting longitudinal acceleration occurring in the vehicle; a road surface gradient estimating means for estimating the gradient of a road surface; a vehicle body speed estimating means for correcting the longitudinal acceleration detected by the longitudinal acceleration detecting means in consideration of the road surface gradient estimated by the road surface gradient estimating means and estimating the vehicle body speed based on a correction value; and a driving force control means for controlling driving force transmitted from each wheel to the road surface based on determination of driving slip using the vehicle body speed estimated by the vehicle body speed estimating means".

CITATION LIST

Patent Literature

Patent Literature 1: JP 2001-82199 A

SUMMARY OF INVENTION

Technical Problem

However, if merely applying the conventional technique described in Patent Literature 1 to a wheel loader having a working device on the front side of a vehicle body, it is impossible to attain balance between slip suppression and excavation performance during excavation work of the earth and sand by the wheel loader. This is because when performing the excavation work by the wheel loader, it is necessary to take into consideration balance between penetration into the earth and sand by traveling traction force and thrust of a hydraulic cylinder associated with lifting operation of the working device after the penetration. In a state in which the lifting operation of the working device is not sufficiently performed after the penetration into the earth and sand, the reaction force of the working device load handling force is not applied to wheels. Meanwhile, when the lifting operation of the working device is performed after the penetration into the earth and sand, the working device load handling force increases accordingly, and thereby the reaction force of the working device load handling force, which is applied to the wheels, also increases. As described above, after the penetration into the earth and sand, slip limit traveling drive force changes in accordance with the change of grounding force of the wheels. If simply limiting the traveling drive force at start of the slip, the slip is suppressed but the force for penetration into the earth and sand is not sufficiently obtained in accordance with the limitation of the traveling drive force, and as a result, sufficient excavation performance is not exhibited.

An objective of the present invention is to provide a wheel loader capable of exhibiting sufficient excavation performance while suppressing slip during excavation.

Solution to Problem

In order to achieve the objective described above, a wheel loader according to the present invention is configured to comprises: a vehicle body to which wheels are attached on a front side and a rear side thereof, respectively; a working device provided on the front side of the vehicle body; a hydraulic cylinder configured to drive the working device; an engine serving as a power source, configured to generate traveling drive force of the vehicle body and thrust of the hydraulic cylinder; an acceleration sensor configured to detect acceleration of the vehicle body; a rotational speed sensor configured to detect rotational speed of the wheels; a thrust sensor configured to detect thrust of the hydraulic cylinder; and a control device configured to control the traveling drive force of the vehicle body, wherein the control device is configured to: determine a reduction value of the traveling drive force based on first vehicle body acceleration of the vehicle body calculated using the acceleration detected by the acceleration sensor, second vehicle body acceleration of the vehicle body calculated using the rotational speed of the wheels detected by the rotational speed sensor, and the thrust of the hydraulic cylinder detected by the thrust sensor; and reduce the traveling drive force based on the reduction value and output the reduced traveling drive force.

Advantageous Effects of Invention

According to the wheel loader of the present invention, it is possible to exhibit sufficient excavation performance while suppressing slip during excavation. Problems, configurations, and effects other than those described above will be clarified by the following description of an embodiment.

DESCRIPTION OF EMBODIMENTS

Hereinafter, an embodiment of a wheel loader according to the present invention will be described with reference to the drawings.

Figure 1:
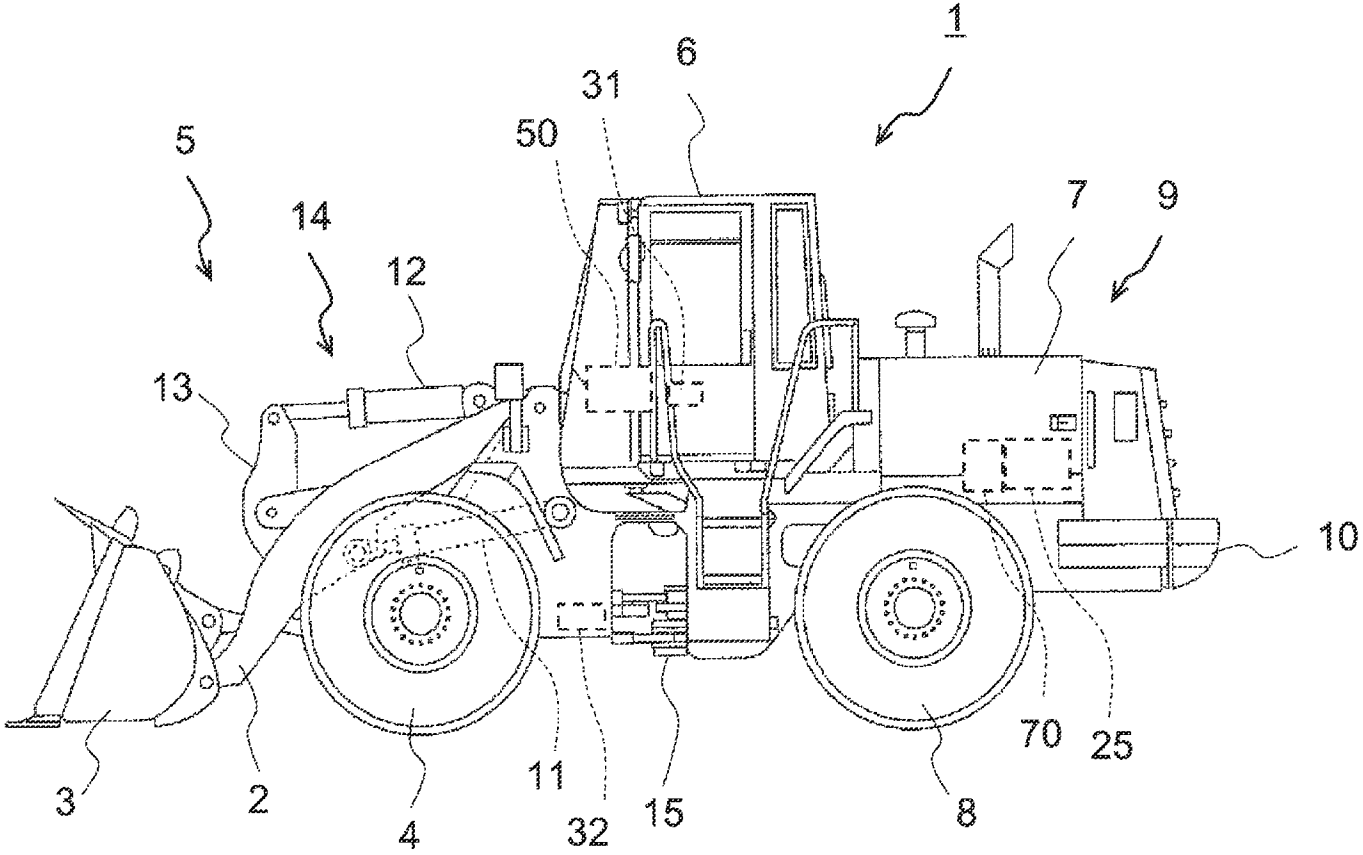
FIG. 1 is a side view of a wheel loader according to an embodiment of the present invention.

FIG. 1 is a side view of a wheel loader 1 according to the embodiment of the present invention. As illustrated in FIG. 1, the wheel loader 1 includes a front frame (vehicle body)

5 having a pair of lift arms 2, a bucket 3, a pair of front wheels 4, etc., and a rear frame (vehicle body) 9 having an operator's cab 6, an engine compartment 7, a pair of rear wheels 8, etc. An engine 25 is mounted in the engine compartment 7, and a counterweight 10 is attached to the rear of the rear frame 9. The operation of the engine 25 is controlled by an engine control unit (hereinafter, referred as ECU) 70.

The pair of lift arms 2 is rotated in the vertical direction (tilting movement) by the driving of a pair of lift arm cylinders 11, and the bucket 3 is rotated in the vertical direction (clouding or dumping) by the driving of a bucket cylinder 12. A link mechanism including a bell crank 13 is interposed between the bucket cylinder 12 and the bucket 3, and the bucket cylinder 12 rotates the bucket 3 via the link mechanism. A working device 14 is constituted by the pair of lift arms 2, the bucket 3, the pair of lift arm cylinders 11, the bucket cylinder 12, the bell crank 13, etc.

A lift arm angle sensor (not illustrated) is attached to a connecting portion between the lift arm 2 and the front frame 5, which is configured to detect the rotation angle of the lift arm 2. In addition, the lift arm cylinder 11 is provided with a bottom side pressure sensor (thrust sensor) 33 for detecting pressure on the bottom side and a rod side pressure sensor (thrust sensor) 34 for detecting pressure on the rod side (see FIG. 3). These pressure sensors 33, 34 are configured to detect working device pressure (object handling load) applied to the working device 14. The bucket cylinder 12 is provided with a proximity switch (not illustrated), so that when the rod of the bucket cylinder 12 is shortened by a predetermined amount, the proximity switch is turned on and the posture of the bucket 3 can be detected.

A rotational speed sensor 32 for detecting the rotational speed of the front wheels 4 and the rear wheels 8 is also provided. In the present embodiment, the rotational speed sensor 32 is configured to detect the rotational speed of an output shaft of a transmission (not illustrated) connected to an output shaft of the engine 25 via a torque converter (not illustrated), and convert the detected rotational speed of the output shaft of the transmission into the rotational speed of the front wheels 4 and the rear wheels 8. Meanwhile, the rotational speed sensor 32 may be configured to directly detect the rotational speed of the front wheels 4 and the rear wheels 8.

The front frame 5 and the rear frame 9 are rotatably connected to each other by a center pin 15, and the front frame 5 is swiveled in the left and right direction with respect to the rear frame 9 by expansion and contraction of a steering cylinder (not illustrated). The operator's cab 6 mounted on a front portion of the rear frame 9 includes such as an operator's seat on which an operator is seated, a steering wheel for controlling a steering angle of the wheel loader 1, a key switch for starting and stopping the wheel loader 1, a display device for providing the operator with information (none of them are illustrated). The operator's cab 6 also includes a controller (control device) 50 for controlling the entire operation of the wheel loader 1, an IMU (Inertial Measurement Unit) 31 for detecting the vehicle body acceleration and the vehicle body angular velocity.

Figure 2:
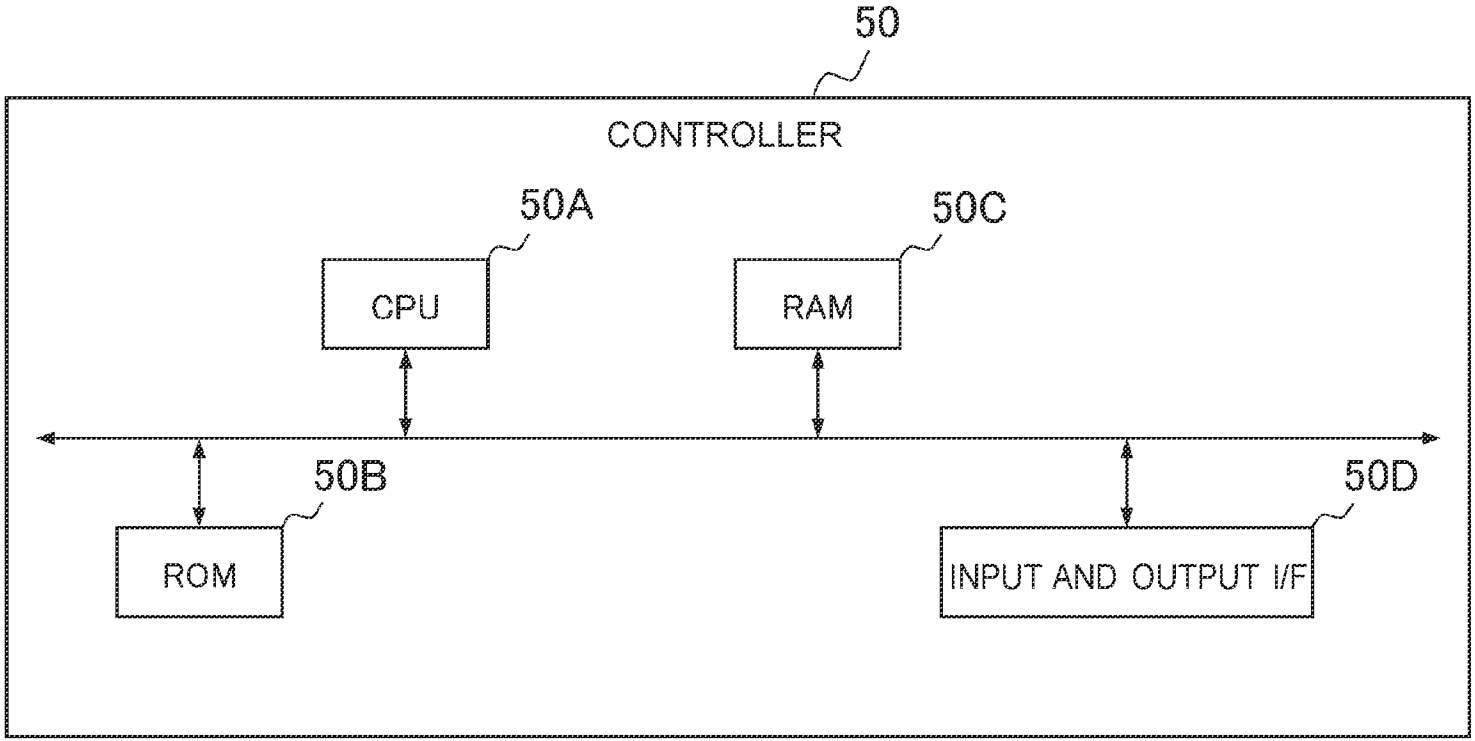
FIG. 2 is a block diagram schematically illustrating hardware configuration of a controller.

FIG. 2 is a block diagram schematically illustrating hardware configuration of the controller 50. As illustrated in FIG. 2, the controller 50 is constituted by hardware including a CPU (Central Processing Unit) 50A configured to perform various calculation for controlling the entire operation of the vehicle body, a storage device such as a ROM (Read Only Memory) 50B configured to store a program for executing the calculation by the CPU 50A, a RAM (Random Access Memory) 50C serving as a work area when the CPU 50A executes the program, and an input and output interface 50D configured to input and output various information and signals to/from an external device.

In the above-described hardware configuration, the program stored in the ROM 50B is read out to the RAM 50C and operated in accordance with the control by the CPU 50A so that the program (software) and the hardware cooperate, and thereby the functional block which realizes the function of the controller 50 is constituted therein.

Figure 3:
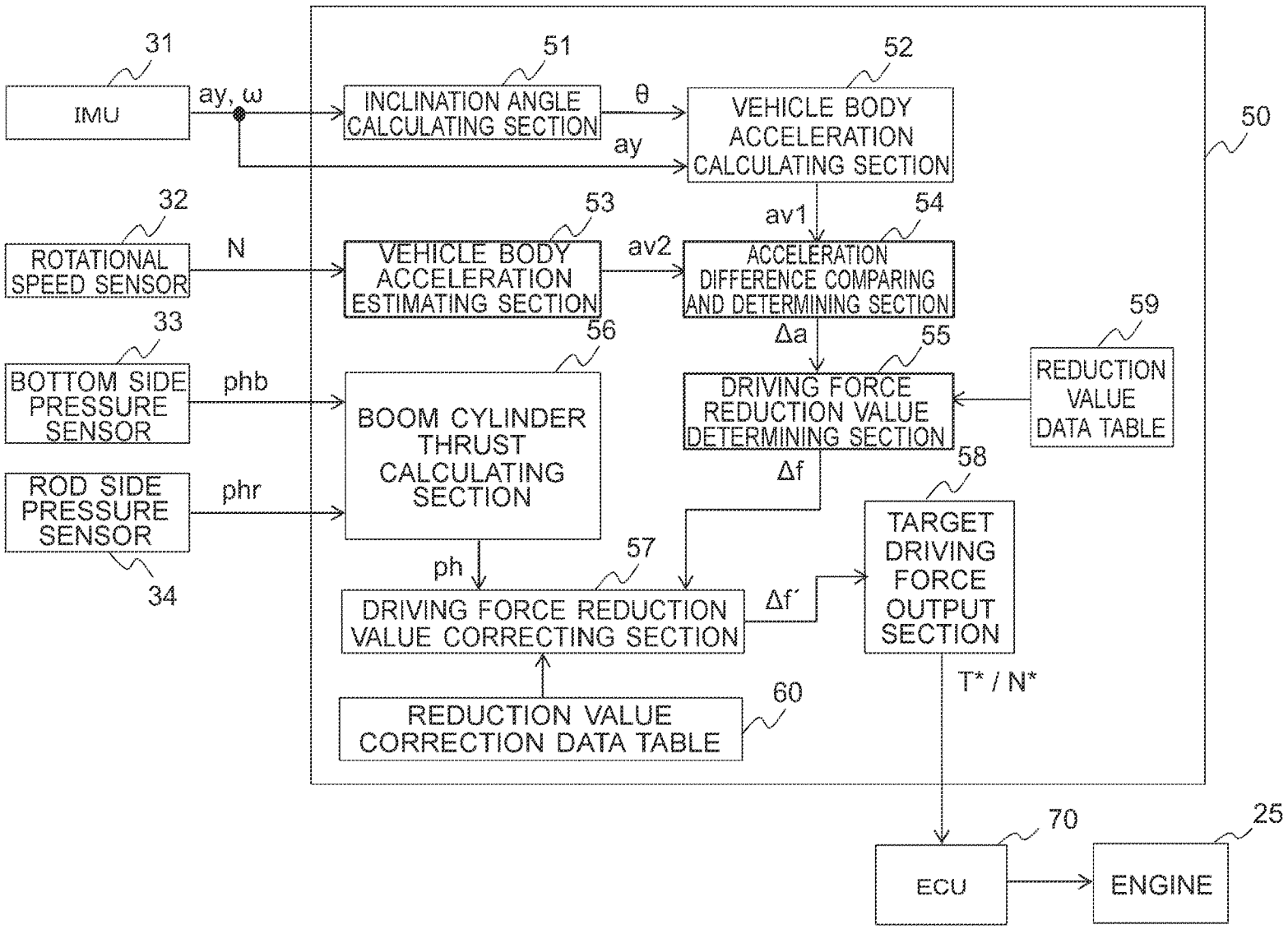
FIG. 3 is a block diagram illustrating functional configuration of a controller.

FIG. 3 is a block diagram illustrating functional configuration of the controller 50. As illustrated in FIG. 3, the controller 50 includes an inclination angle calculating section 51 configured to calculate an inclination angle θ of the vehicle body, a vehicle body acceleration calculating section 52 configured to calculate first vehicle body acceleration of the vehicle body, a vehicle body acceleration estimating section 53 configured to estimate second vehicle body acceleration of the vehicle body, an acceleration difference comparing and determining section 54 configured to compare and determine acceleration difference between the first vehicle body acceleration calculated by the vehicle body acceleration calculating section 52 and the second vehicle body acceleration estimated by the vehicle body acceleration estimating section 53, a driving force reduction value determining section 55 configured to temporarily determine a reduction value of the driving force (output torque) output from the engine 25, a lift arm cylinder thrust calculating section 56 configured to calculate thrust of the lift arm cylinders 11, and a driving force reduction value correcting section 57 configured to correct the reduction value of the driving force temporarily determined by the driving force reduction value determining section 55, a target driving force output section 58 configured to output target driving force (target output torque) of the engine 25, a reduction value data table 59, and a reduction value correction data table 60.

Figure 4:
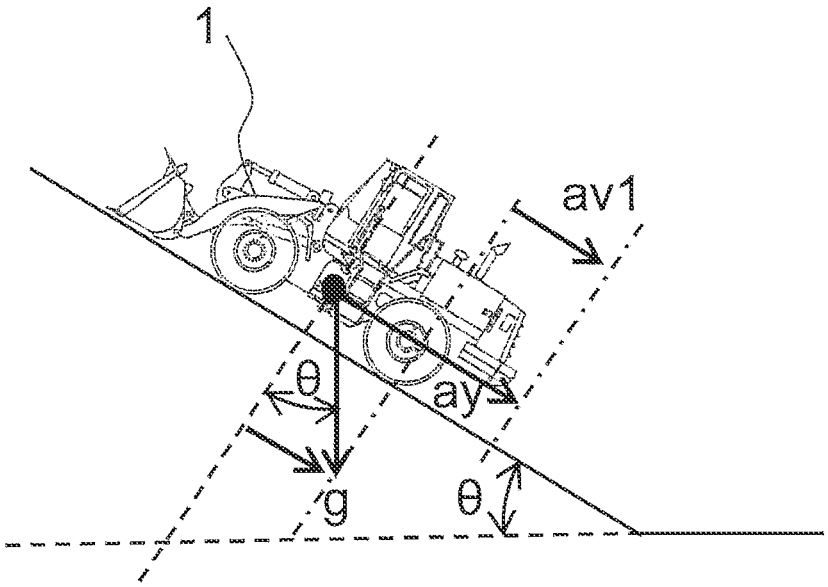
FIG. 4 is an analytical model diagram for calculating an inclination angle and first vehicle body acceleration.
Figure 5:
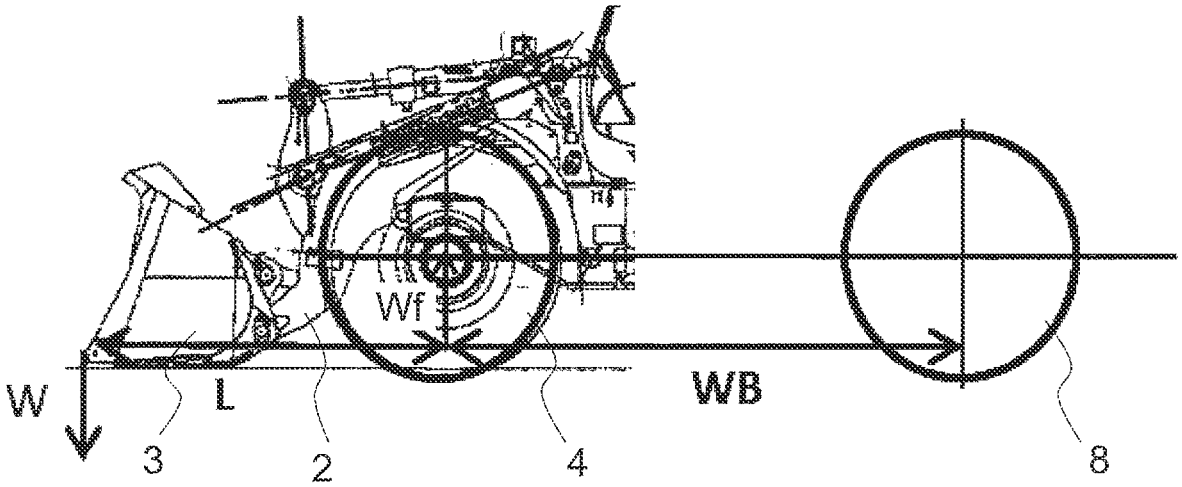
FIG. 5 is an analytical model diagram for correcting a reduction value of driving force of an engine.
Figure 6:
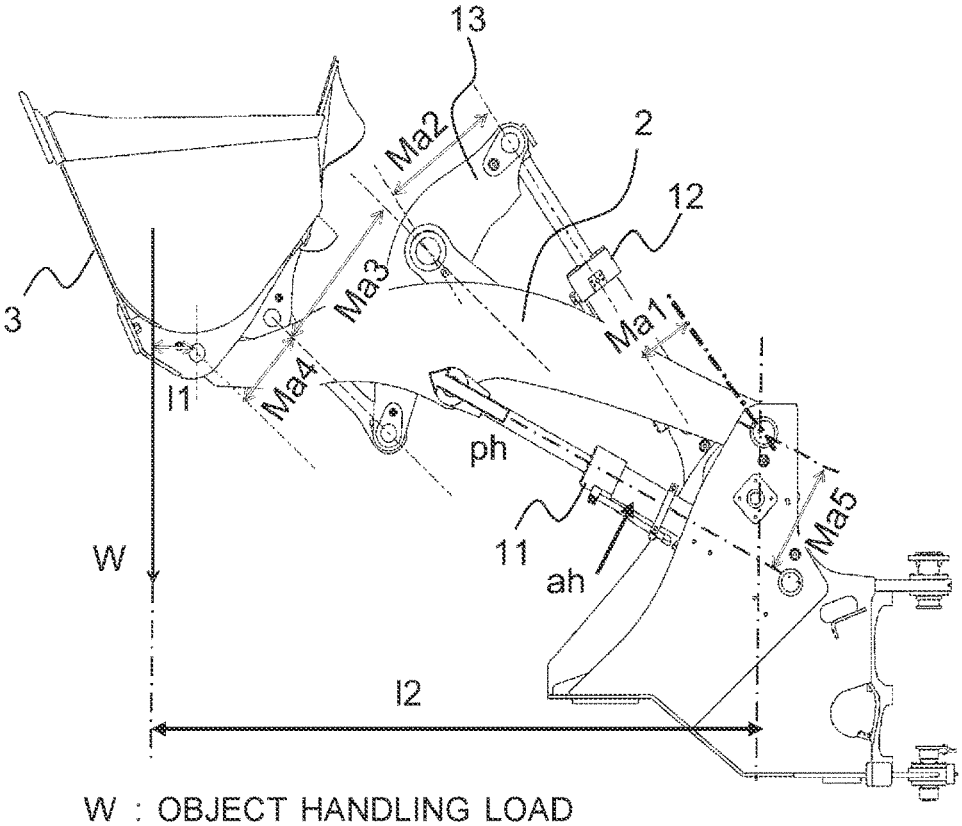
FIG. 6 is an analytical model diagram for correcting a reduction value of driving force of an engine.

Hereinafter, the functional configuration of the controller 50 will be described in detail mainly with reference to FIG. 3, and appropriately with reference to FIGS. 4 to 6. FIGS. 4 to 6 illustrate analytical models for performing various calculations, specifically, FIG. 4 is an analytical model diagram for calculating an inclination angle θ and first vehicle body acceleration av1, and FIGS. 5 and 6 are analytical model diagrams for correcting the reduction value of the driving force of the engine 25.

The inclination angle calculating section 51 inputs each data of acceleration ay of the y-direction component and angular velocity co which are detected by the IMU 31 to a Kalman filter, and calculates an inclination angle θ (see FIG. 4). Since the processing by the Kalman filter is well known, the description thereof is omitted here.

The vehicle body acceleration calculating section 52 calculates first vehicle body acceleration av1 by substituting the acceleration ay of the y-direction component detected by the IMU 31 and the inclination angle θ calculated by the inclination angle calculating section 51 into the following Equation 1.

$$av1 = ay - g \times \sin\theta \quad \text{[Equation 1]}$$

The vehicle body acceleration estimating section 53 calculates (estimates) second vehicle body acceleration av2 by substituting rotational speed N (rpm) of the front wheels 4 and the rear wheels 8 detected by the rotational speed sensor 32 into the following Equation 2. The second vehicle body acceleration av2 is an estimation value based on data detected by the rotational speed sensor 32.

$$av2 = \frac{d[\alpha \times N]}{dt} \quad \text{[Equation 2]}$$

Here, α is a vehicle body speed conversion factor.

The acceleration difference comparing and determining section 54 subtracts the first vehicle body acceleration av1 calculated by the vehicle body acceleration calculating section 52 from the second vehicle body acceleration av2 estimated by the vehicle body acceleration estimating section 53 to calculate acceleration difference (difference) Δa between the first vehicle body acceleration av1 and the second vehicle body acceleration av2, and compares and determines whether the acceleration difference Δa is equal to or greater than a predetermined value.

Figure 7:
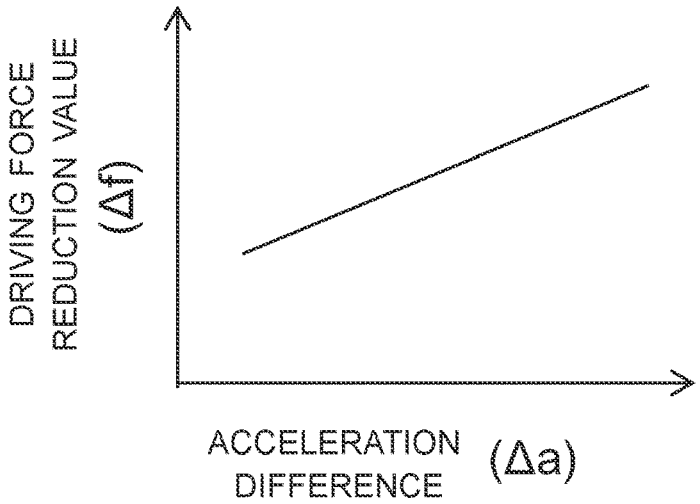
FIG. 7 illustrates a reduction value data table.

The driving force reduction value determining section 55 refers to the reduction value data table 59 illustrated in FIG. 7, and temporarily determines a target driving force reduction value Δf from the acceleration difference Δa calculated by the acceleration difference comparing and determining section 54. Here, the reduction value data table 59 illustrated in FIG. 7 is a characteristic in which the driving force reduction value Δf increases in proportion to the acceleration difference Δa. That is, in the present embodiment, as the acceleration difference Δa increases, the driving force is reduced since it is assumed that slip is occurring. The reduction value data table 59 is stored in advance in the ROM 50B. The driving force reduction value determining section 55 can calculate the driving force reduction value Δf by substituting the acceleration difference Δa into the following Equation 3, without referring to the reduction value data table 59.

$$\Delta f = \alpha m \Delta a \quad \text{[Equation 3]}$$

Here, m is the mass of the vehicle body, and α is a correction factor.

The lift arm cylinder thrust calculating section 56 calculates lift arm cylinder thrust (hydraulic load) ph by substituting pressure phb on the bottom side of the lift arm cylinders 11 detected by the bottom side pressure sensor 33 and pressure phr on the rod side of the lift arm cylinders 11 detected by the rod side pressure sensor 34 into the following Equation 4.

Note that calculation of ph is performed by multiplication of a factor, etc. in consideration of pressure receiving areas on the bottom side and the rod side of the lift arm cylinders 11.

$$ph = phb - phr \quad \text{[Equation 4]}$$

The driving force reduction value correcting section 57 corrects the driving force reduction value Δf temporarily determined by the driving force reduction value determining section 55 based on the lift arm cylinder thrust ph calculated by the lift arm cylinder thrust calculating section 56, and outputs a corrected driving force reduction value Δf' to the target driving force output section 58. Since the load (excavation reaction force) during object handling work such excavation acts on the vehicle body, in particular, the grounding force of the front wheels 4 with respect to the ground increases, so that slip is less likely to occur. Accordingly, when the load during the object handling work is applied to the vehicle body, the driving force can be increased as compared with the case where the load during the object handling work is not applied to the vehicle body. In other words, the driving force reduction value Δf temporarily determined can be reduced during the object handling work. Accordingly, the driving force reduction value correcting section 57 corrects the reduction value of the driving force to be small in accordance with the hydraulic load (object handling load) acting on the lift arm cylinders 11. A specific calculation method will be described in the following, appropriately with reference to FIGS. 5 and 6.

When the load Wf is applied to the front wheels 4 by the object handling work, slip is less likely to occur, so that the driving force can be increased. The increase of the driving force by the load Wf can be calculated by the following Equation 5.

$$\Delta f - \Delta f' = \mu \Delta Wf \quad \text{[Equation 5]}$$

Here, ΔWf is increase in the load applied to the front wheels 4, and μ is a friction factor.

From the Equation 5, Δf' can be expressed by the following Equation 6.

$$\Delta f' = \Delta f - \mu \Delta Wf \quad \text{[Equation 6]}$$

Referring to FIG. 5, ΔWf can be expressed by the following Equation 7 from moment balance.

$$\Delta Wf = (L + WB) \times \frac{W}{(WB)} \quad \text{[Equation 7]}$$

Here, L is object handling load point length, WB is wheel base length, and W is object handling load.

When substituting the Equation 7 into the Equation 6, the corrected driving force reduction value Δf' can be expressed by the following Equation 8.

$$\Delta f' = \Delta f - \mu (L + WB) \times \frac{W}{(WB)} \quad \text{[Equation 8]}$$

Referring to FIG. 6, the object handling load W can be expressed by the following Equation 9 according to mechanism calculation.

$$W = \frac{ph \times Ma5}{l2 - l1 \times \frac{Ma1}{R}} \quad \text{[Equation 9]}$$

$$\left\{ R = \frac{Ma2 \times Ma4}{Ma3} \right\}$$

Here, ph is lift arm cylinder thrust (hydraulic load), and 11, 12, and Ma1 to Ma5 are mechanical parameters determined by the load handling posture.

When substituting the Equation 9 into the Equation 8, the corrected driving force reduction value Δf' can be expressed by the following Equation 10.

$$\Delta f' = \Delta f - \mu (L + WB) \times \frac{W}{(WB)} \times \frac{ph \times Ma5}{l2 - l1 \times \frac{Ma1}{R}} \quad \text{[Equation 10]}$$

Figure 8:
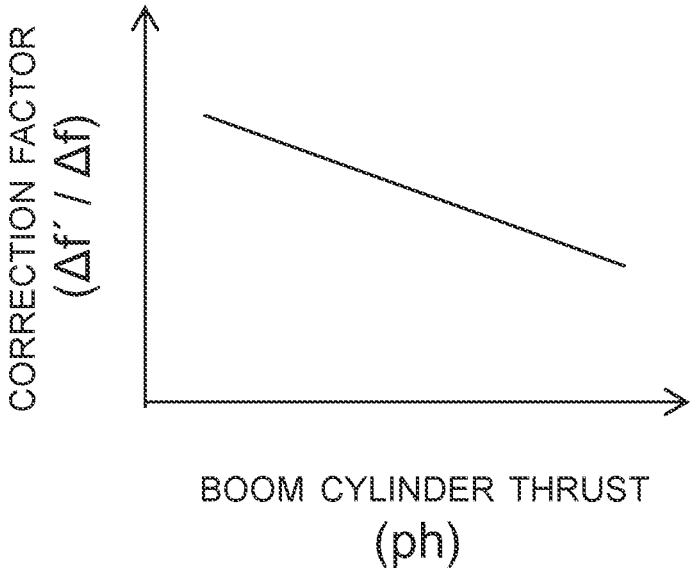
FIG. 8 illustrates a reduction value correction data table.

In this manner, the driving force reduction value correcting section 57 can calculate a value by correcting the driving force reduction value Δf using the Equation 10, that is, the corrected driving force reduction value Δf'. In the present embodiment, the calculation for correcting the driving force reduction value Δf is simplified by using the reduction value correction data table 60 illustrated in FIG. 8. More specifically, the reduction value correction data table 60 illustrated in FIG. 8 has a characteristic in which the correction factor (Δf'/Δf) increases in inverse proportion to the lift arm cylinder thrust ph. That is, in the present embodiment, the larger the load handling load (excavation reaction force) is, the more difficult it is for slip to occur, so that the correction factor becomes small. As a result, the corrected driving force reduction value Δf' becomes small. When the corrected driving force reduction value Δf' is small, the value of the target driving force to be output becomes large, so that it is possible to make the wheel loader 1 travel with the large driving force as compared with the case where the object handling load is small. The reduction value correction data table 60 is stored in advance in the ROM 50B.

The target driving force output section 58 outputs a target torque command T* or a target rotational speed command N* to the ECU 70 so as to reduce the driving force by the corrected driving force reduction value Δf' corrected by the driving force reduction value correcting section 57. The ECU 70 controls the driving force of the engines 25 in accordance with this command.

Figure 9:
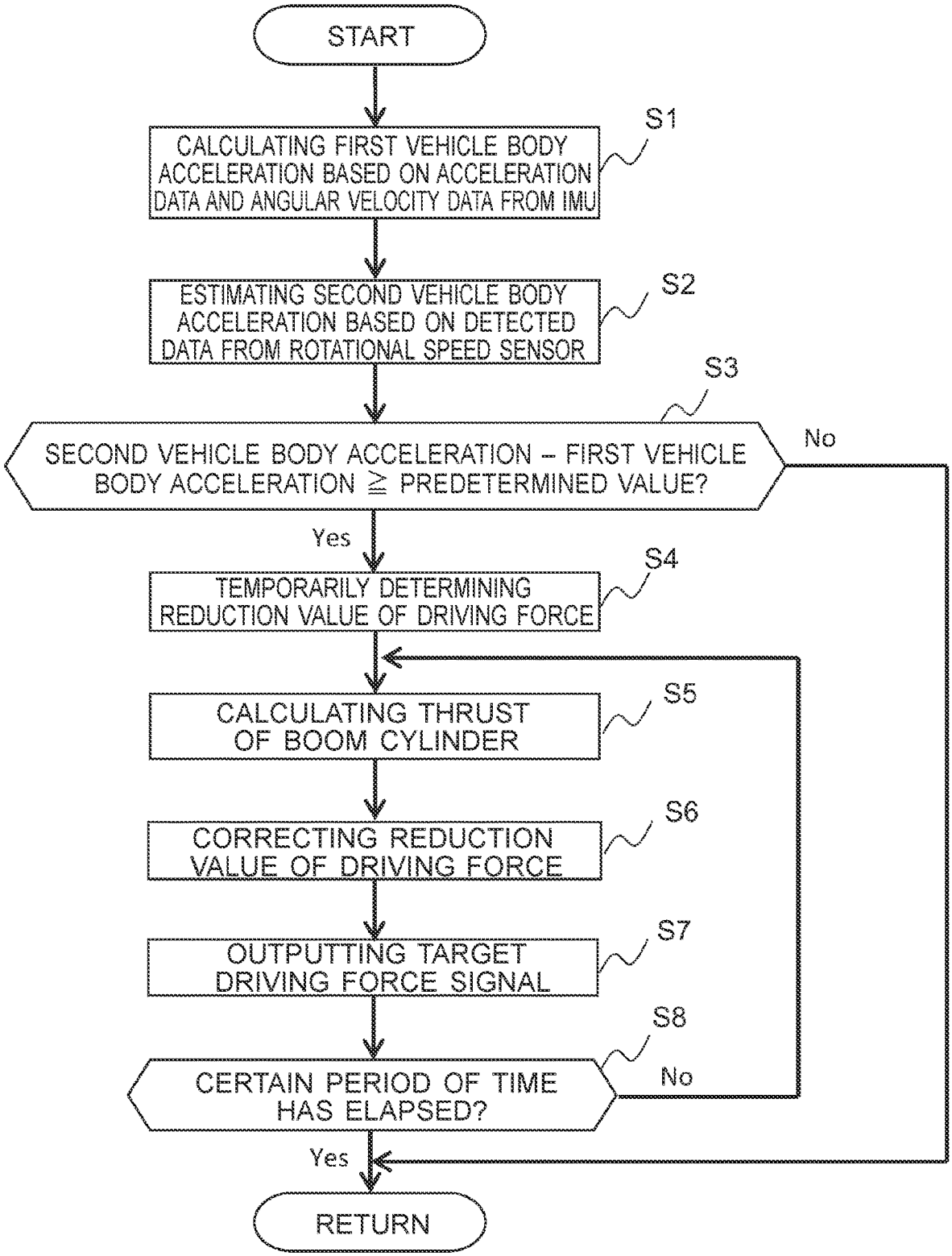
FIG. 9 illustrates a flowchart showing a procedure of control processing for engine driving force performed by a controller.

Next, a procedure of the control processing by the controller 50 will be described. FIG. 9 illustrates a flowchart showing the procedure of the control processing for engine driving force performed by the controller 50. When the key switch of the wheel loader 1 is turned on, the controller 50 starts the processing illustrated in FIG. 9.

Firstly, in step S1, the inclination angle calculating section 51 calculates an inclination angle θ of the vehicle body based on each data of the acceleration ay and the angular velocity co input from the IMU 31. The vehicle body acceleration calculating section 52 calculates first vehicle body acceleration av1 based on the inclination angle θ and the acceleration ay.

Next, in step S2, the vehicle body acceleration estimating section 53 calculates (estimates) second vehicle body acceleration av2 based on data of rotation speed N input from the rotation speed sensor 32.

Next, in step S3, the acceleration difference comparing and determining section 54 subtracts the first vehicle body acceleration av1 from the second vehicle body acceleration av2 to obtain acceleration difference Δa, and determines whether the acceleration difference Δa is equal to or greater than a predetermined value. Here, the predetermined value is set as a threshold value for determining whether the wheel loader 1 is slipping, and is predetermined by calculation or experience in consideration of specifications such as weight and size of the wheel loader 1. The predetermined value is stored in advance in the ROM 50B.

When the difference Δa is equal to or greater than the predetermined value (step S3/Yes), it is determined that the wheel loader 1 is slipping, and a processing for reducing the driving force is performed. Specifically, in step S4, the driving force reduction value determining section 55 refers to the reduction value data table 59 and determines a driving force reduction value Δf. Next, in step S5, the lift arm cylinder thrust calculating section 56 calculates lift arm cylinder thrust ph based on the bottom side pressure data and the rod side pressure data of the lift arm cylinders 11 detected by the pressure sensors 33, 34.

Next, in step S6, the driving force reduction value correcting section 57 refers to the reduction value correction data table 60 and calculates a corrected driving force reduction value Δf' based on the driving force reduction value Δf and the lift arm cylinder thrust ph. When the lift arm cylinder thrust ph is zero, the corrected driving force reduction value Δf' calculated in step S6 has the same value as the driving force reduction value Δf, and accordingly, the output target driving force becomes traveling drive force necessary for slip suppression when the object handling work is not considered.

Next, in step S7, the target driving force output section 58 outputs a target driving force signal to the ECU 70 so as to reduce the traveling drive force by the corrected driving force reduction value Δf', and repeats the steps of S5 to S8 until a certain period of time elapses in step S8.

Here, the certain period can be set to a time required for single excavation work performed by the wheel loader 1. For example, at the time of performing V-shaped excavation work, it can be set to a time (for example, about 5 seconds to 10 seconds) until the wheel loader 1 is switched to reverse after advancing to thrust the bucket 3 into a pile of the earth and sand or the like, scooping the earth and sand or the like by the bucket 3, and moving up the bucket 3. In this way, it is possible to perform the object handling work efficiently while reliably preventing slip until the single excavation work is completed.

When the certain period of time elapses (step S8/Yes), the processing returns to the start. If NO in step S3, the acceleration difference comparing and determining section 54 determines that no slip has occurred. Then, the processing proceeds to the return and returns to the start.

As described above, according to the present embodiment, even when the wheel loader 1 is slipping, since the traveling drive force is corrected so as to increase in accordance with the object handling load (excavation reaction force), it is possible to exhibit sufficient excavation performance while suppressing slip during excavation. Furthermore, since the thrust of the lift arm cylinders 11 is calculated by the pressure sensors 33, 34 on the bottom side and the rod side of the lift arm cylinders 11, which are usually provided in the wheel loader 1, and the traveling driving force is corrected, it is unnecessary to provide a separate sensor for calculating the object handling load, which makes it possible to suppress the cost. Still further, there is an advantage that the load of the calculation processing by the controller 50 can be reduced by performing the calculation using the reduction value data table 59 and the reduction value correction data table 60.

It should be noted that the embodiments as described above are examples of the present invention, and are not intended to limit the scope of the present invention only thereto. Those skilled in the art can practice the present invention in various other ways without departing from the concept of the invention.

For example, if preparing a plurality of the reduction value data table 59 and the reduction value correction data table 60 so that the operator can select them in accordance with the environment (road surface condition, etc.) in the object handling work, it is possible to perform the object handling work efficiently while suppressing slip with higher accuracy. Furthermore, instead of using the IMU 31, an acceleration sensor for detecting the acceleration ay of the vehicle body, an inclination sensor for detecting the inclination angle θ of the vehicle body, etc. may be separately provided. In addition, by providing a vehicle speed sensor instead of the rotational speed sensor 32, it is possible to calculate the rotational speed of the wheels from the vehicle speed detected by the vehicle speed sensor.

In the present invention, the reduction of the traveling drive force is performed until a certain time of time elapses. Meanwhile, it also can be configured to detect that the wheel loader 1 is switched from advancing to reversing, and thereby the reduction of the traveling drive force is ended.

LIST OF REFERENCE SIGNS

1 wheel loader
2 lift arm
3 bucket
4 front wheel (wheels)
8 rear wheel (wheels)
5 front frame (vehicle body)
9 rear frame (vehicle body)
11 lift arm cylinder (hydraulic cylinder)
12 bucket cylinder (hydraulic cylinder)
13 bell crank
14 working device
25 engine
31 IMU (acceleration sensor)
32 rotational speed sensor
33 bottom side pressure sensor (thrust sensor)
34 rod side pressure sensor (thrust sensor)
50 controller (control device)

The invention claimed is:

1. A wheel loader comprising:

a vehicle body to which wheels are attached on a front side and a rear side thereof, respectively;

a working device provided on the front side of the vehicle body;

a hydraulic cylinder configured to drive the working device;

an engine serving as a power source, configured to generate traveling drive force of the vehicle body and thrust of the hydraulic cylinder;

an acceleration sensor configured to detect acceleration of the vehicle body;

an inclination sensor for detecting an inclination angle (θ) of the vehicle body;

a rotational speed sensor configured to detect rotational speed of the wheels;

a thrust sensor configured to detect thrust of the hydraulic cylinder; and a control device configured to control the traveling drive force of the vehicle body, wherein the control device is configured to:

calculate a first vehicle body acceleration of the vehicle body by subtracting a value obtained by multiplying a gravitational acceleration by sin θ from the acceleration detected by the acceleration sensor;

calculate a second vehicle body acceleration of the vehicle body by differentiating the rotational speed of the wheels detected by the rotational speed sensor by time;

calculate an acceleration difference which is a difference between the first vehicle body acceleration and the second vehicle body acceleration; wherein in a case where the acceleration difference is greater than or equal to a predetermined value, the control device temporarily determines a reduction value of the traveling drive force so that the reduction value becomes larger as the acceleration difference increases, corrects the temporarily determined reduction value so that the reduction value becomes smaller as the thrust of the hydraulic cylinder detected by the thrust sensor becomes larger, and reduces the traveling drive force by the corrected reduction value.

2. The wheel loader according to claim 1, wherein the working device includes a lift arm rotatably attached to the vehicle body, a bucket rotatably attached to the lift arm, a lift arm cylinder as the hydraulic cylinder configured to operate the lift arm, and a bucket cylinder as the hydraulic cylinder configured to operate the bucket, a bottom side pressure sensor is provided as the thrust sensor configured to detect pressure on a bottom side of the lift arm cylinder and a rod side pressure sensor is provided as the thrust sensor configured to detect pressure on a rod side of the lift arm cylinder are provided, the rod side of the lift arm facing a rod of the bucket cylinder, and the control device is configured to calculate thrust of the lift arm cylinder by using the bottom side pressure sensor and the rod side pressure sensor.

3. The wheel loader according to claim 1, wherein the control device is further configured to:

temporarily determine the reduction value by referring to a reduction value data table which is pre-mapped so that the reduction value of the traveling drive force becomes larger as the acceleration difference becomes larger, and correct the temporarily determined reduction value by referring to a reduction value correction data table which is pre-mapped so that the reduction value becomes smaller as the thrust of the hydraulic cylinder becomes larger.

4. The wheel loader according to claim 1, wherein the working device includes a lift arm rotatably attached to the vehicle body, a bucket rotatably attached to the lift arm, a lift arm cylinder as the hydraulic cylinder configured to operate the lift arm, and a bucket cylinder as the hydraulic cylinder configured to operate the bucket, a bottom side pressure sensor is provided as the thrust sensor configured to detect pressure on a bottom side of the lift arm cylinder and a rod side pressure sensor is provided as the thrust sensor configured to detect pressure on a rod side of the lift arm cylinder are provided, the rod side of the lift arm facing a rod of the bucket cylinder, and the control device is configured to calculate thrust of the lift arm cylinder by using the bottom side pressure sensor and the rod side pressure sensor.

* * * * *